US005865175A

United States Patent [19]

Chu

[11] Patent Number: 5,865,175

[45] Date of Patent: Feb. 2, 1999

[54] RESCUING HELMET HAVING ILLUMINATING DEVICE

[76] Inventor: Chien Chang Chu, No. 67, Lane 20, Sec. 2, Chih Yu Road, Taipei, Taiwan

[21] Appl. No.: 937,596

[22] Filed: Sep. 29, 1997

[51] Int. Cl.[6] ..... A62B 17/04; A62B 18/00; A62B 7/00; A62B 9/00

[52] U.S. Cl. ..... 128/205.22; 128/201.23

[58] Field of Search ..... 128/201.22, 201.28, 128/202.13, 202.27, 205.13, 205.22, 201.23

[56] References Cited

U.S. PATENT DOCUMENTS

| | | | |
|---|---|---|---|
| 428,611 | 5/1890 | Hurd | 128/205.22 |
| 2,362,643 | 11/1944 | Lambertsen | 128/205.22 |
| 2,906,262 | 9/1959 | Braunstein | 128/205.22 |
| 4,233,970 | 11/1980 | Kranz | 128/201.28 |
| 4,440,163 | 4/1984 | Spergel | 128/205.13 |
| 4,960,120 | 10/1990 | Constance-Hughes | 128/205.22 |
| 5,113,854 | 5/1992 | Dosch et al. | 128/201.23 |
| 5,119,808 | 6/1992 | Marquardt et al. | 128/201.22 |
| 5,315,987 | 5/1994 | Swann | 128/201.28 |
| 5,553,606 | 9/1996 | Chen | 128/202.13 |
| 5,676,135 | 10/1997 | McClean | 128/205.22 |

*Primary Examiner*—Kimberly L. Asher
*Attorney, Agent, or Firm*—Beveridge, DeGrandi, Weilacher & Young LLP

[57] ABSTRACT

The present invention relates to a rescuing helmet having an illuminating device, a heat resistant helmet body, a fastening strap, a controlling unit and a compressed air tank. The heat resistant helmet body is provided with an air conduct for connecting a hose. The lower peripheral of the helmet body is provided with a resilient strap and the lower portion of the resilient strap is provided with a fastening strap. The other end of the fastening strap is connected with an air tank. The top outlet of the air tank is provided with a controlling unit which is configured with a metering throttle, a cover and a light triggering device. The metering throttle is provided with an air supplying duct to supply the fresh air to the helmet body via a hose. In use, the user may readily wear the helmet body and dispose the air tank in front of the chest. The metering throttle is then switched on such that a metered flow of air is supplied to the helmet body. Meanwhile, the light is also simultaneously triggered to light a rescue or escape path. The rescuing helmet features a simple, compact configuration which is affordable by all people. Most important, the rescuing device may save the life of the user during a fire.

2 Claims, 8 Drawing Sheets

RESCUING HELMET HAVING ILLUMINATING DEVICE

FIELD OF THE INVENTION

The present invention relates to a rescuing helmet having an illuminating device, a heat resistant helmet body, a fastening strap, a controlling unit and a compressed air tank. This rescuing helmet is suitable for use in a fire. The controlling unit is provided with a metered throttle to regulate and control the air supplied to the helmet body. The light can be simultaneously triggered on by the light triggering portion disposed within the controlling unit. The user can be supplied with a prolonged supply of air and light for escaping from a fire.

DESCRIPTION OF PRIOR ART

The existing rescuing mask for fires is directly enveloped onto the head of the user. The mouth portion of the rescuing mask is provided with an activated charcoal to filter out toxic gas. However, when a fire occurs, the oxygen level in the area of the fire is comparatively lower and even the filtered air is inhaled, and the user can not be supplied with sufficient air/oxygen. When the oxygen supply is reduced, the chance of getting saved is also lowered. As a result, there is still room for improving the existing rescuing device.

SUMMARY OF THE INVENTION

It is the objective of this invention to provide a rescuing helmet which is compact and easy to use within a fire.

It is the objective of this invention to provide a rescuing helmet wherein the toxic gas within the fire can be completely isolated.

It is the objective of this invention to provide a rescuing helmet that is easy to make and the cost is low while it provides a prolonged period of air supply and light such that the chance of being saved is increased.

In order to achieve the objectives set forth, the metering throttle can be simply switched on by depressing the switching portion of the controlling device. The fresh and compressed air can be readily supplied to the helmet body which is heat resistant. The rescuing helmet is also provided with a light with which the rescuing path can be readily spotted. The helmet body is made from heat resistant material which can be readily used by adults and children. By the provision of the rescuing helmet, the toxic gas can be completely isolated and the user can be readily saved.

BRIEF DESCRIPTION OF DRAWINGS

In order that the present invention may more readily be understood the following description is given, merely by way of example with reference to the accompanying drawings, in which.

DETAILED DESCRIPTION OF PREFERRED EMBODIMENT

Figure 1:
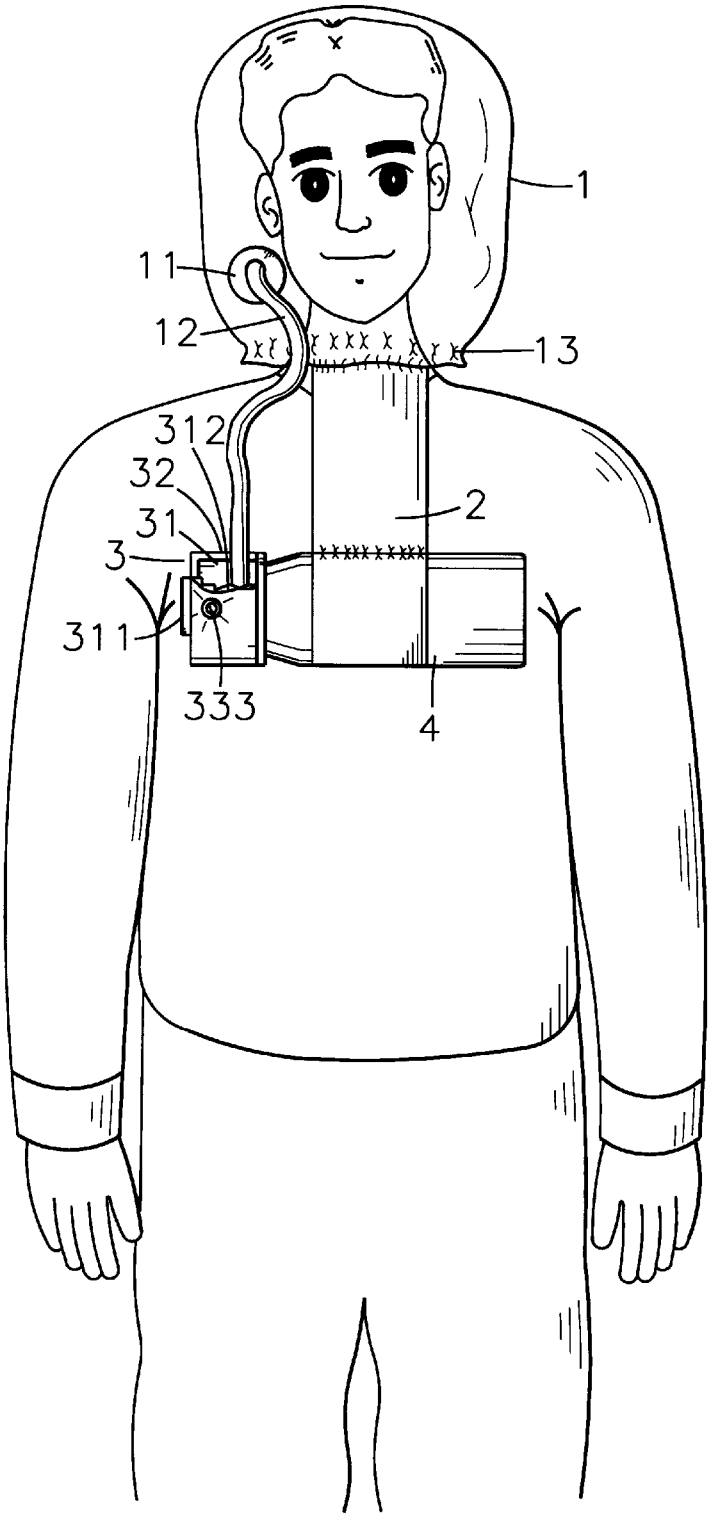
FIG. 1 is a schematic illustration showing the use of the rescuing helmet made according to the present invention.

Referring to FIG. 1, the rescuing helmet generally includes a heat resistant helmet body 1, a fastening strap 2, a controlling unit 3 and a compressed air tank 4.

Figure 2:
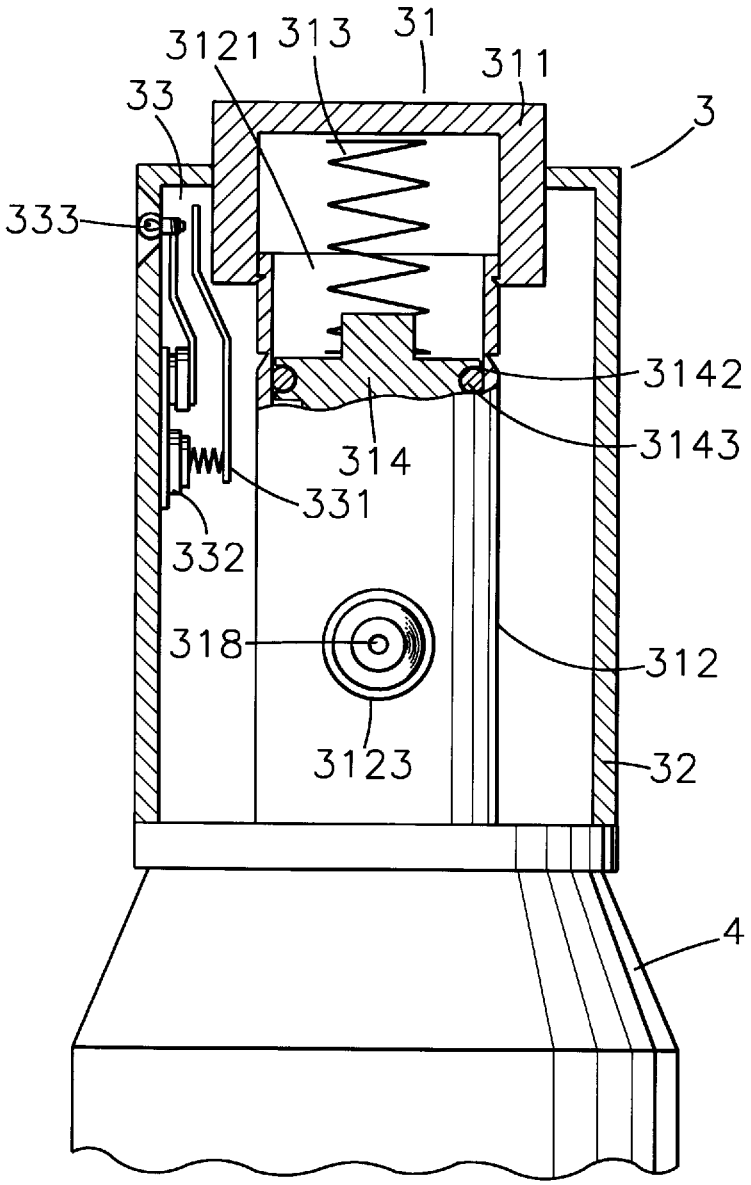
FIG. 2 is a cross sectional view of the controlling device.
Figure 3:
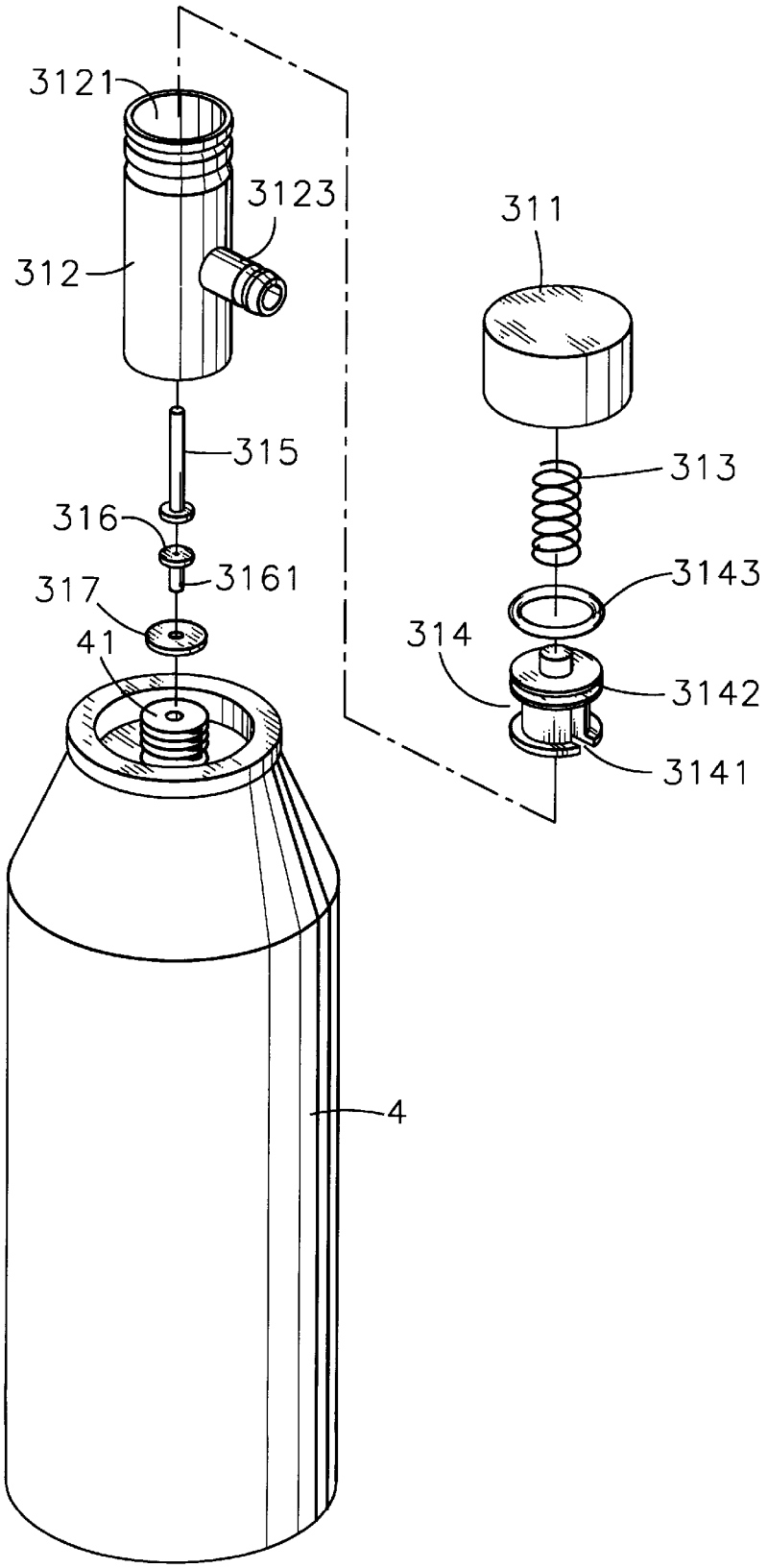
FIG. 3 is an exploded perspective view of the metering throttle.
Figure 4:
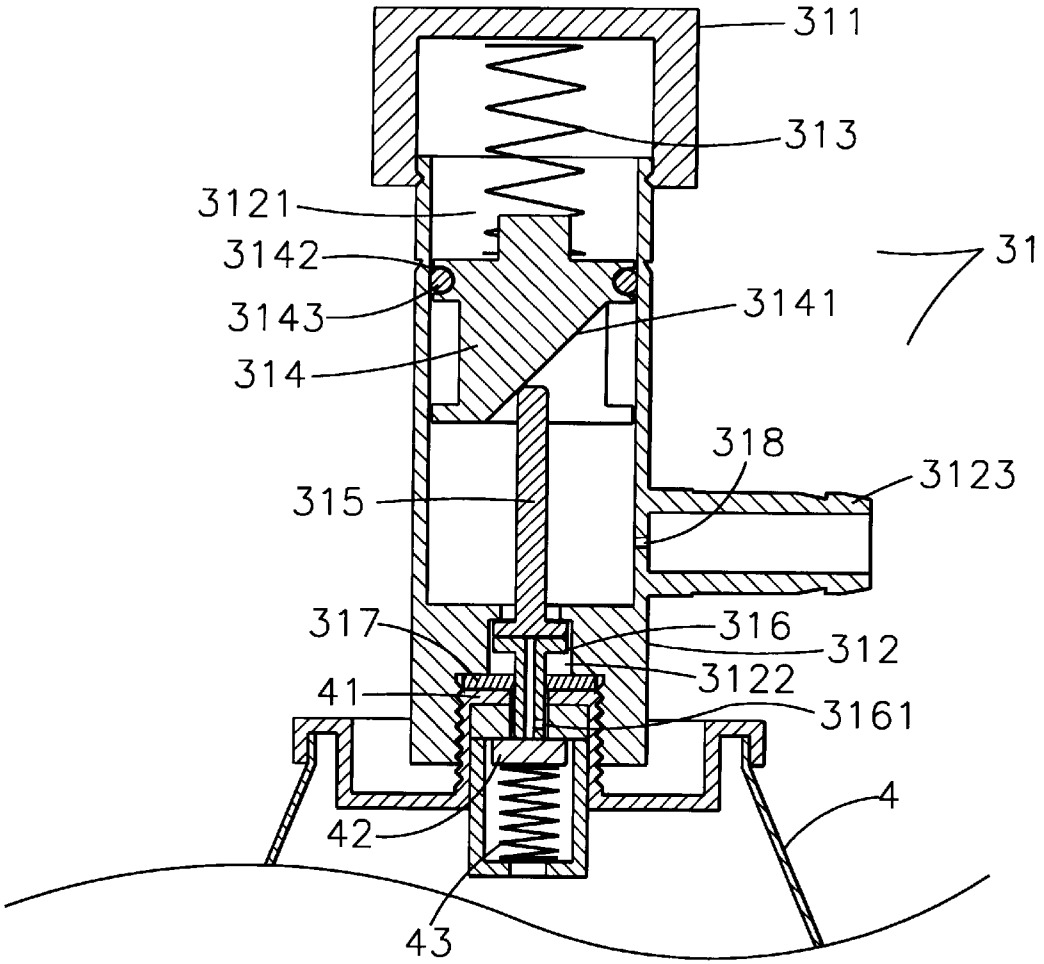
FIG. 4 is a cross sectional view of the metering throttle.

The heat resistant helmet body 1 is provided with an air conduct 11 for connecting a hose 12. The lower peripheral of the helmet body 1 is provided with a resilient strap 13. The lower portion of the resilient strap 13 is provided with a fastening strap 2. The other end of the fastening strap 2 is connected with an air tank 4. Referring to FIG. 2, the top outlet of the air tank 4 is provided with a controlling unit 3. The controlling unit 3 includes a metering throttle 31, a cover 32 and a light triggering device 33. Referring to FIGS. 3 and 4, the metering throttle 31 is configured with a main barrel 312 having a first receiving chamber 3121 at its top. The receiving chamber 3121 is disposed with an actuating spring 313 and an actuator 314. The outer peripheral of the main barrel 312 is provided with an air supplying duct 3123 which is aligned with an orifice 318. The main barrel 312 is provided with a switching portion 311 atop. The actuator 314 is provided with an annular groove 3142 in which a rubber ring 3143 is disposed and which is pressed against the inner wall of the first receiving chamber 3121.

The main barrel 31 is further provided with a second receiving chamber 3122 which is located under the actuating portion 3141 of the actuator 314 and which is slantly disposed. The second receiving chamber 3122 is provided with an actuating rod 315 and a discharging valve 316 is disposed thereunder. The lower end of the discharging valve 316 is passed through an opening of a washer 317 and which is further extended into the nozzle 41 of the air tank 4. The lower end of the discharging valve 316 is firmly pressed against an upper portion of the pressing tab 42.

Furthermore, the discharging portion of the air tank 4 is provided with a cover 32 in which a light triggering portion 33 is mounted. The switching portion 311 of the metering throttle 31 is projected above the cover 32 such that the user may press it to switch on the air supply.

Figure 5:
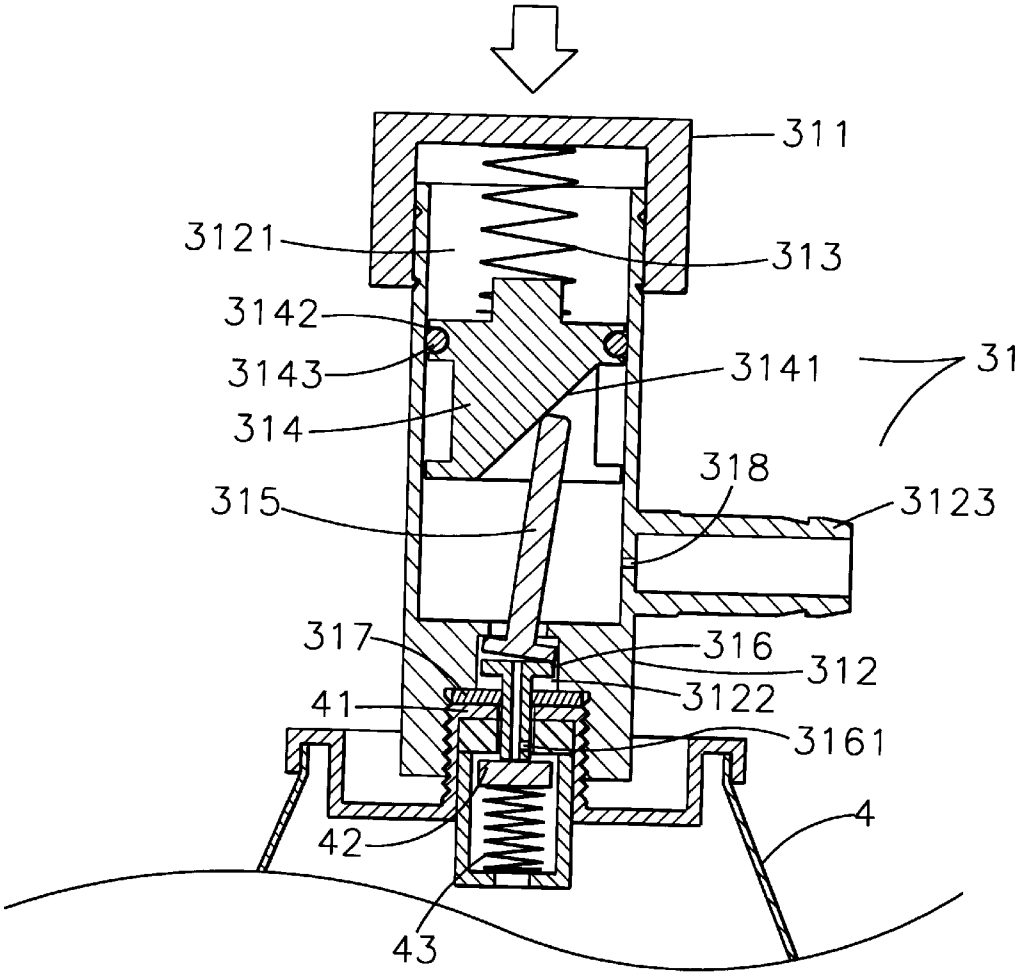
FIG. 5 is a schematic illustration of the metering throttle showing the operation thereof.

Referring to FIGS. 2 and 5, when the switching portion 311 is depressed by the user, the actuating plate 331 of the light triggering device 33 will be pressed such that the positive terminal of the light 333 is triggered and the power from the battery 332 is supplied to the light 333. On the other hand, the actuating rod 315, which is under the actuating portion 3141, is inclined and pushed toward the discharging valve 316, the pressing tab 42 and the spring 43. Then the compressed air within the air tank 4 is released through the side gap of the pressing tab 42 and then enters into the orifice 3161 of the discharging valve 316. The air then enters into the first receiving chamber 3121 via the second receiving chamber 3122 and accumulates in the space under the actuator 314. The built-up air will push the actuator 314 as the pressure increases thereof. However, part of the air pressure is sustained by the actuating spring 313 and not all the downward spring force is released. By this arrangement, the air is released from the orifice 318 to the air supplying duct 3123 in a metered manner. Then the released fresh air will be supplied to the heat resistant helmet body 1 via the hose 12.

Figure 6:
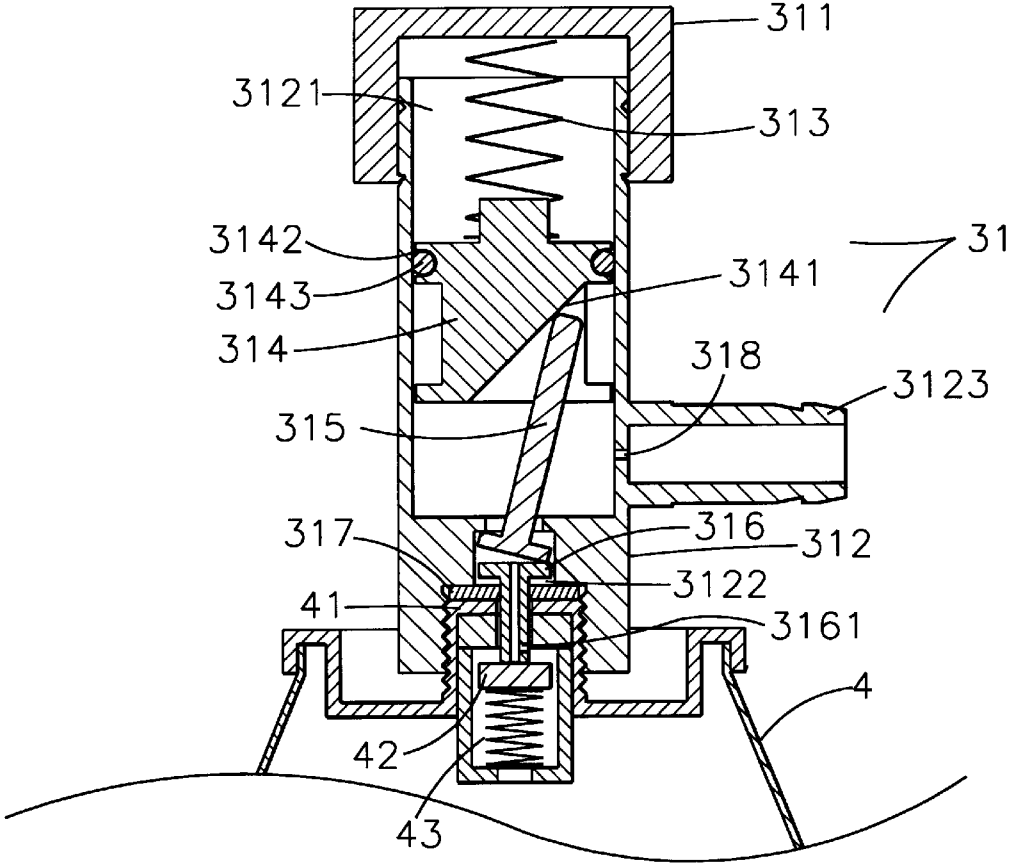
FIG. 6 is a cross sectional view of the metering throttle showing the post stage thereof.

Referring to FIG. 6, when the amount of the compressed air is lowered to a preset level, the upward pressure exerted onto the actuator 314 is also lowered such that the actuating spring 313 is pushed downward and applies a downward force to the actuator 314. By this arrangement, the actuator 314 is pushed lower within the actuating portion 3141 such that the inclined angle of the actuator 314 displaces the actuating rod 315 further from the discharging valve 316. By this arrangement, the amount of air released is still kept at a constant level. As a result, the air supplied to the helmet body 1 is maintained at the same level.

Referring to FIG. 1, which is a schematic illustration of the use of the rescuing helmet in case a fire occurs, the user may simply wear the helmet body 1 and dispose the air tank 4 in front of the chest with the fastening strap 2. Then the user simply depresses the switching portion 311 of the metering throttle 31. Then the helmet body 1 is immediately supplied with a constant air stream. When the switching portion 311 is depressed, the light triggering portion 33 is also triggered such that the light 333 is turned on. By this arrangement, the user may see clearly to find his/her way out of the fire. As the air tank 4 and the battery may last for a certain period of time, the chance of getting out and surviving a fire is also increased.

Figure 7:
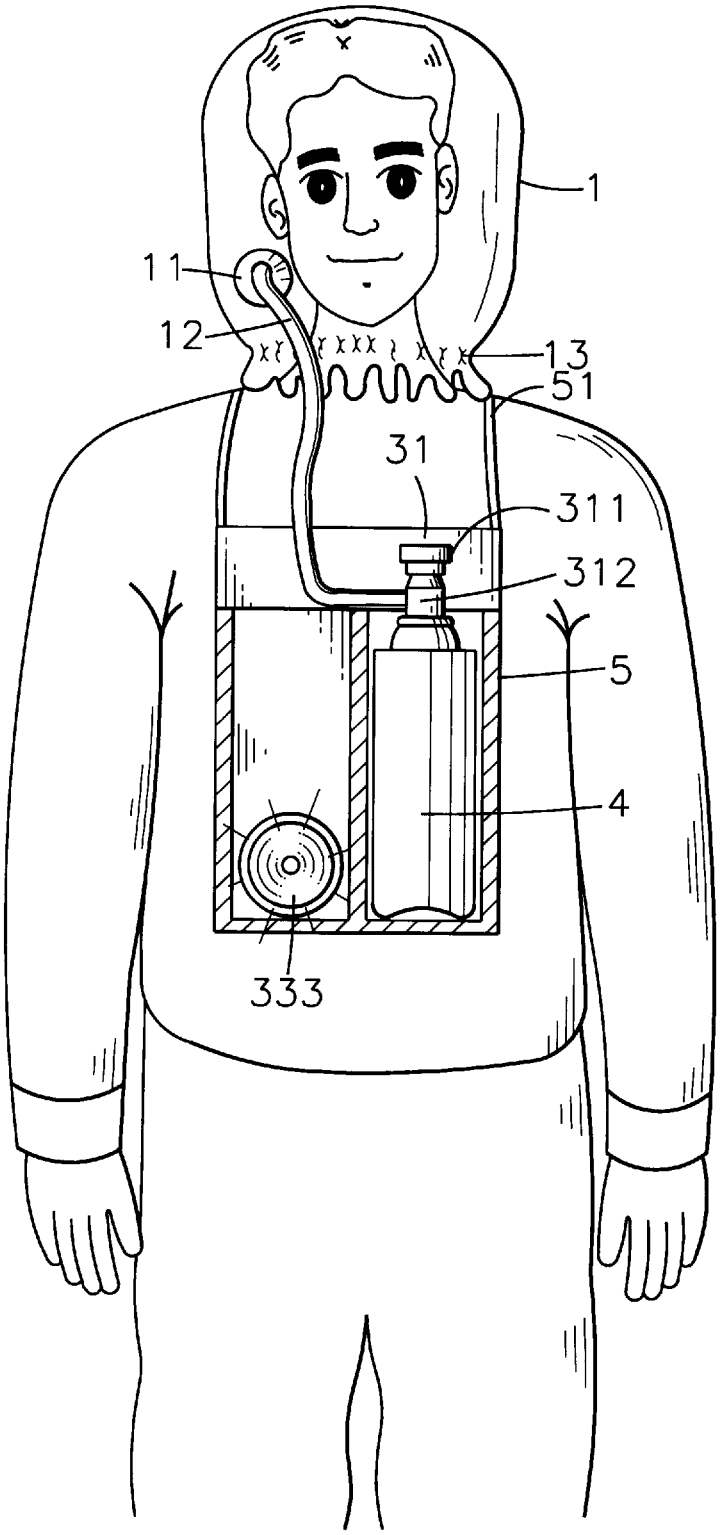
FIG. 7 is a plan view of another embodiment of the rescuing helmet.

Referring to FIG. 7, which is a plan view of another embodiment of the rescuing embodiment made according to the present invention, the air tank 4 can be an oxygen container 5 and the light 333 of the triggering portion 33 can be disposed at side of the oxygen container 5. The top of the oxygen container 5 is extended with a hanging strap 51 which can be used to hang the oxygen container 5 onto the wall. By this arrangement, the oxygen container 5 is readily accessible when needed, i.e. the user can be immediately supplied with fresh air.

Figure 8:
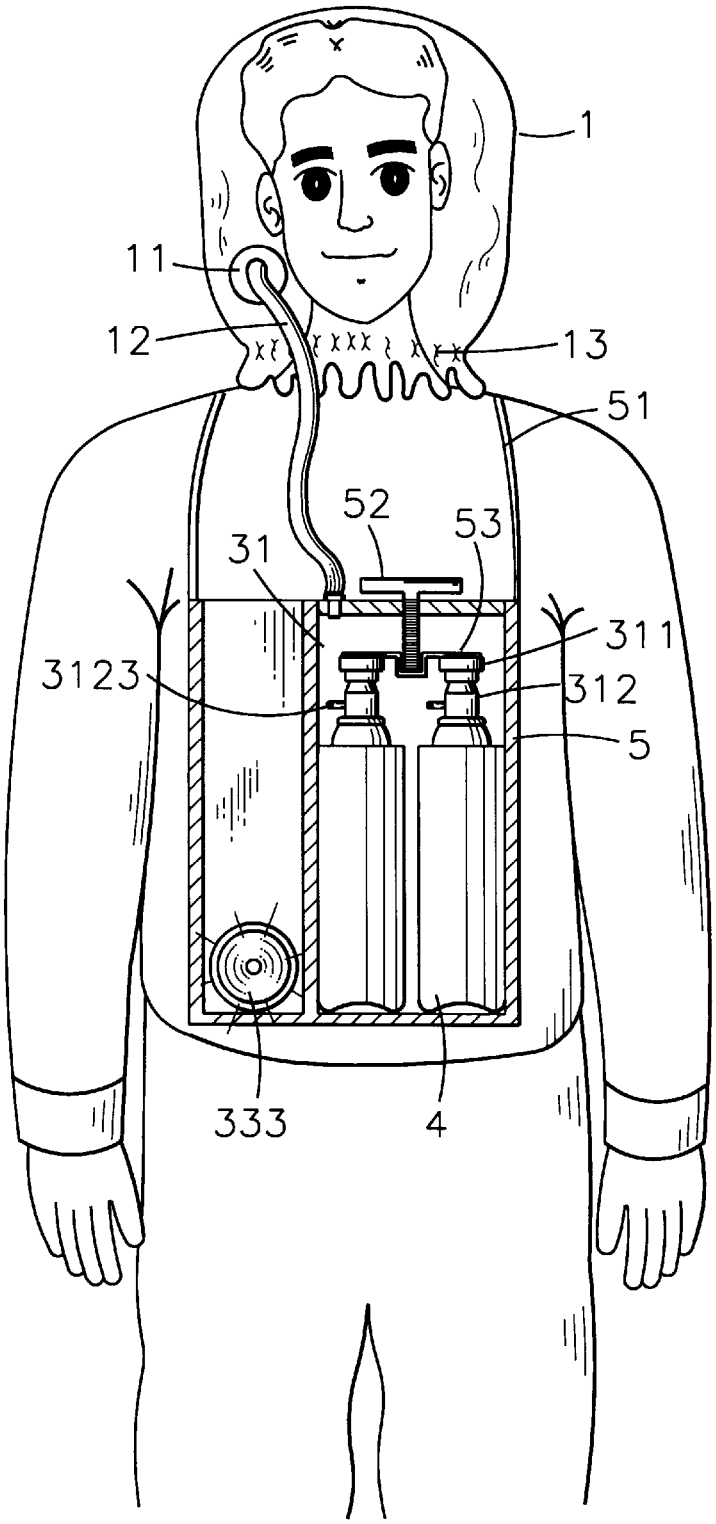
FIG. 8 is a plan view of a third embodiment of the rescuing helmet.

Another embodiment of the rescuing helmet is shown in FIG. 8. It can be readily seen that there are two air tanks 4 disposed within the oxygen container which is especially suited for highrise buildings and skyscrapers. As the amount of the air is increased, the chance of being rescued during a fire in a highrise building or skyscraper is also increased. In use, the switch 52 can be rotated such that a pressing tab 53 is directly pressed against the switching portion 311 to switch on the air supply.

From the foregoing description, it can be readily appreciated that the rescuing helmet features a simple, compact configuration which can be readily manufactured at a low cost. While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of the present invention.

I claim:

1. A rescuing helmet comprising:

an illuminating device, a heat resistant helmet body, a fastening strap, a controlling unit, and a compressed air tank;

said heat resistant helmet body being provided with an air conduit for connecting a hose thereto, a lower peripheral of said helmet body being provided with a resilient strap and a lower portion of said resilient strap being provided with a fastening strap, the other end of said fastening strap being connected with said air tank, a top outlet of said air tank being provided with a controlling unit which is configured with a metering throttle, a cover and a light triggering device, said metering throttle being provided with an air supplying duct to supply fresh air to said helmet body via said hose;

said metering throttle is configured with a main barrel having a first receiving chamber at a top of said main barrel and which is disposed with an actuating spring and an actuator, an outer peripheral of said main barrel being provided with an air supplying duct which is aligned with an orifice which is located on a wall of the main barrel, a switching portion attached to the top of said main barrel, said actuator being provided with an annular groove in which a rubber ring is disposed and which is pressed against an inner wall of said first receiving chamber, said main barrel being further provided with a second receiving chamber which is located under said actuator and which is slantly disposed, the lower portion of said actuating rod being extended into said second receiving chamber and further pressing against a discharging valve disposed thereunder, a lower end of said discharging valve being passed through an opening of a washer and which is further extended into a nozzle of said air tank, wherein said main barrel is screwed onto the nozzle of said air tank and a cover is used to enclose said main barrel;

wherein when those components are assembled in order, said helmet body can be simply worn on a head of a user and said switching portion of said metering throttle is depressed such that a constant air stream of fresh air is supplied to said helmet body, meanwhile, said light triggering portion is also triggered to switch on said light for illuminating, whereby the user is provided with fresh air and light for a prolonged period.

2. A rescuing helmet comprising an illuminating device, a heat resistant helmet body, a hanging strap, a controlling unit, and an oxygen container;

said heat resistant helmet body being provided with an air conduit for connecting a hose thereto, a lower peripheral of said helmet body being provided with a resilient strap, said hanging strap attached to said oxygen container, wherein said hanging strap is placed around a neck of an user, a top outlet of said oxygen container being provided with a controlling unit which is configured with a metering throttle, a cover and a light triggering device, said metering throttle being provided with an air supplying duct to supply fresh air to said helmet body via said hose;

said metering throttle is configured with a main barrel having a first receiving chamber at a top of said main barrel and which is disposed with an actuating spring and an actuator, an outer peripheral of said main barrel being provided with an air supplying duct which is aligned with an orifice which is located on a wall of the main barrel, a switching portion attached to the top of said main barrel, said actuator being provided with an annular groove in which a rubber ring is disposed and which is pressed against an inner wall of said first receiving chamber, said main barrel being further provided with a second receiving chamber which is located under said actuator and which is slantly disposed, the lower portion of said actuating rod being extended into said second receiving chamber and further pressing against a discharging valve disposed thereunder, a lower end of said discharging valve being passed through an opening of a washer and which is further extended into a nozzle of said oxygen container, wherein said main barrel is screwed onto the nozzle of said oxygen container and a cover is used to enclose said main barrel;

wherein when those components are assembled in order, said helmet body can be simply worn on a head of the user and said switching portion of said metering throttle is depressed such that a constant air stream of fresh air is supplied to said helmet body, meanwhile, said light triggering portion is also triggered to switch on said light for illuminating, whereby the user is provided with fresh air and light for a prolonged period.

* * * * *